US006835301B1

(12) United States Patent
Ellis et al.

(10) Patent No.: US 6,835,301 B1
(45) Date of Patent: Dec. 28, 2004

(54) PRODUCTION OF LOW SULFUR/LOW AROMATICS DISTILLATES

(75) Inventors: Edward S. Ellis, Basking Ridge, NJ (US); Henry Jung, Mendham Borough, NJ (US); William E. Lewis, Baton Rouge, LA (US)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/457,434

(22) Filed: Dec. 7, 1999

Related U.S. Application Data

(60) Provisional application No. 60/111,346, filed on Dec. 8, 1998.

(51) Int. Cl.[7] ..... C10G 65/12

(52) U.S. Cl. ..... 208/89; 208/58; 208/210; 585/264

(58) Field of Search ..... 208/89, 58, 210; 585/264

(56) References Cited

U.S. PATENT DOCUMENTS

| | | | | |
|---|---|---|---|---|
| 2,952,626 | A | 9/1960 | Kelley et al. | 208/210 |
| 2,987,467 | A | 6/1961 | Keith et al. | 208/97 |
| 3,017,345 | A | 1/1962 | Eastman et al. | 208/210 |
| 3,091,586 | A | 5/1963 | Pappas et al. | 208/210 |
| 3,124,526 | A | 3/1964 | Butler et al. | 208/264 |
| 3,147,210 | A | 9/1964 | Hass et al. | 208/210 |
| 3,211,641 | A | 10/1965 | Halik et al. | 208/59 |
| 3,228,871 | A | 1/1966 | Schlinger et al. | 208/58 |
| 3,268,438 | A | 8/1966 | Scott, Jr. et al. | 208/89 |
| 3,413,216 | A | 11/1968 | Doumani | 208/216 |
| 3,415,737 | A | 12/1968 | Kluksdahl | 208/139 |
| 3,425,810 | A | 2/1969 | Scott, Jr. | 23/289 |
| 3,450,784 | A | 6/1969 | Reilly et al. | 260/667 |
| 3,461,063 | A | 8/1969 | Stine et al. | 208/143 |
| 3,595,779 | A | 7/1971 | Peck et al. | 208/210 |
| 3,607,723 | A | 9/1971 | Peck et al. | 208/59 |
| 3,658,681 | A | 4/1972 | Wilson et al. | 208/211 |
| 3,671,420 | A | 6/1972 | Wilson et al. | 208/61 |
| 3,673,078 | A | 6/1972 | Kirk, Jr. | 208/89 |
| 3,714,030 | A | 1/1973 | Winsor et al. | 208/210 |
| 3,767,562 | A | 10/1973 | Sze et al. | 208/57 |
| 3,775,291 | A | 11/1973 | Sze | 208/57 |
| 3,788,976 | A | 1/1974 | Kirk, Jr. | 208/89 |

(List continued on next page.)

FOREIGN PATENT DOCUMENTS

| | | | |
|---|---|---|---|
| GB | 1323257 | 7/1973 | C10G/13/24 |

*Primary Examiner*—Jerry D. Johnson
(74) *Attorney, Agent, or Firm*—Gerard J. Hughes; Jeremy J. Kliebert

(57) ABSTRACT

A process for hydroprocessing a hydrotreated liquid distillate stream to produce a stream exceptionally low in sulfur as well as aromatics. A hydrotreated distillate stream is further hydrotreated in a co-current reaction zone wherein the reaction product is passed to a separation drum wherein a vapor product is collected overhead and a liquid product is passed to a aromatics saturation zone countercurrent to the flow of hydrogen treat gas.

11 Claims, 1 Drawing Sheet

U.S. PATENT DOCUMENTS 3,843,508 A 10/1974 Wilson et al. ..... 208/89
3,846,278 A 11/1974 Sze et al. ..... 208/57
3,897,329 A 7/1975 Franz et al. ..... 208/210
3,905,893 A 9/1975 Christman et al. ..... 208/210
3,915,841 A * 10/1975 Murphy, Jr. et al.
4,021,330 A 5/1977 Satchell, Jr. ..... 208/89
4,022,682 A 5/1977 Bludis et al. ..... 208/89
4,026,674 A 5/1977 McDonald ..... 23/283
4,194,964 A 3/1980 Chen et al. ..... 208/108
4,212,726 A 7/1980 Mayes ..... 208/101
4,213,847 A 7/1980 Chen et al. ..... 208/111
4,243,519 A 1/1981 Schorfheide ..... 208/210
4,457,834 A 7/1984 Caspers et al. ..... 208/143
4,476,069 A 10/1984 Harper et al. ..... 261/97
4,526,757 A 7/1985 Gupta ..... 422/106
4,591,426 A 5/1986 Krasuk et al. ..... 208/96
4,599,162 A 7/1986 Yen ..... 208/59
4,624,748 A 11/1986 Haunschild ..... 203/29
4,755,281 A 7/1988 Penick ..... 208/108
4,801,373 A 1/1989 Corman et al. ..... 208/210
4,952,306 A 8/1990 Sawyer et al. ..... 208/216
5,026,459 A 6/1991 Quang et al. ..... 202/158
5,082,551 A 1/1992 Reynolds et al. ..... 208/100
5,110,444 A * 5/1992 Haun et al.
5,114,562 A * 5/1992 Haun et al.
5,183,556 A 2/1993 Reilly et al. ..... 208/57
5,252,198 A 10/1993 Harrison et al. ..... 208/208 R
5,262,044 A 11/1993 Huizinga et al. ..... 208/107
5,292,428 A 3/1994 Harrison et al. ..... 208/208 R
5,348,641 A 9/1994 Shih ..... 208/89
5,366,614 A 11/1994 Russ et al. ..... 208/65
5,378,348 A 1/1995 Davis et al. ..... 208/27
5,449,501 A 9/1995 Luebke et al. ..... 422/193
5,518,607 A 5/1996 Field et al. ..... 208/212
5,522,983 A 6/1996 Cash et al. ..... 208/59
5,670,116 A 9/1997 Gupta et al. ..... 422/191
5,705,052 A 1/1998 Gupta ..... 208/57
5,720,872 A 2/1998 Gupta ..... 208/57
5,741,414 A * 4/1998 Waku et al.
5,779,992 A 7/1998 Higashi ..... 422/190
5,882,505 A 3/1999 Wittenbrink et al. ..... 208/59
5,888,376 A 3/1999 Wittenbrink et al. ..... 208/59
5,888,377 A 3/1999 Bertram ..... 208/59
5,906,728 A 5/1999 Iaccino et al. ..... 208/61
5,925,235 A 7/1999 Habib ..... 208/111.35
5,939,031 A 8/1999 Ellis et al. ..... 422/191
5,942,197 A 8/1999 Gupta et al. ..... 422/191
5,985,131 A 11/1999 Gupta et al. ..... 208/57
6,007,787 A 12/1999 Gupta et al. ..... 422/191
6,623,622 B2 * 9/2003 Gupta ..... 208/59

* cited by examiner

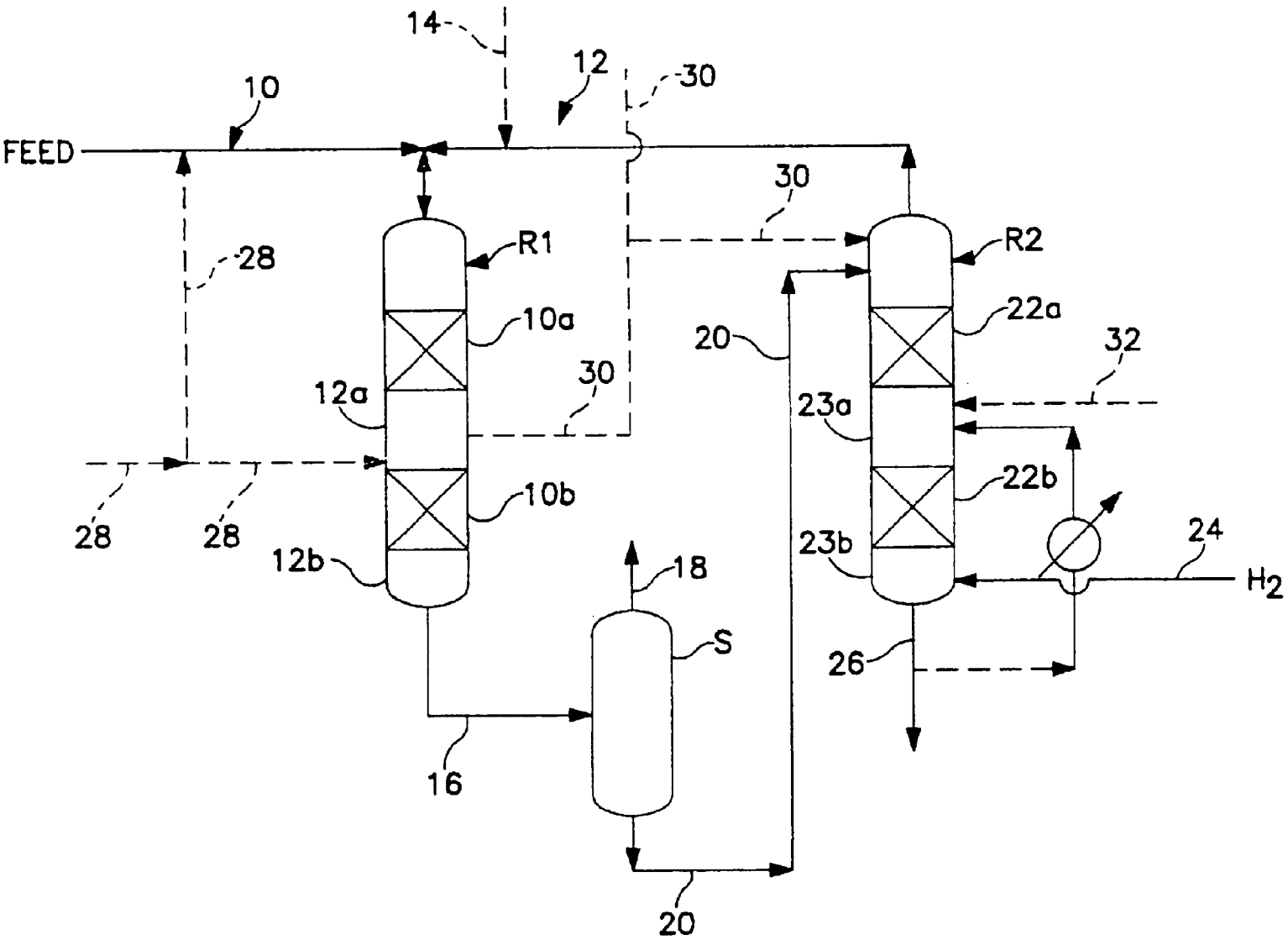
FEED
10
28
28
28
12a
12b
14
12
30
30
R1
10a
10b
16
S
18
20
20
30
R2
22a
22b
32
23a
23b
26
24
H2

PRODUCTION OF LOW SULFUR/LOW AROMATICS DISTILLATES

This application claims the benefit of Provisional application Ser. No. 60/111,346, filed Dec. 8, 1998.

BACKGROUND OF THE DISCLOSURE

1. Field of the Invention

The present invention relates to a process for hydroprocessing a hydrotreated liquid distillate stream to produce a stream exceptionally low in sulfur as well as aromatics. A hydrotreated distillate stream is further hydrotreated in a co-current reaction zone wherein the reaction product is passed to a separation zone thereby producing a vapor phase product and a liquid phase product. The resulting vapor phase product is collected overhead and the resulting liquid phase product is passed to an aromatics saturation stage and passed through a bed of hydrogenation catalyst countercurrent to the flow of hydrogen-containing treat gas.

2. Background of the Invention

Environmental and regulatory initiatives are requiring ever lower levels of both sulfur and aromatics in distillate fuels. For example, proposed sulfur limits for distillate fuels to be marketed in the European Union for the year 2005 is 50 wppm or less. There are also regulations that will require lower levels of total aromatics in hydrocarbons and, more specifically, to lower levels of multiring aromatics found in distillate fuels and heavier hydrocarbon products. Further, the maximum allowable aromatics level for U.S. on-road diesel, CARB reference diesel, and Swedish Class I diesel are 35, 10 and 5 vol. %, respectively. Further, the CARB and Swedish Class I diesel fuels allow no more than 1.4 and 0.02 vol. % polyaromatics, respectively. Consequently, much work is presently being done in the hydrotreating art to meet these regulations.

Hydrotreating, or in the case of sulfur removal, hydrodesulfurization, is well known in the art and usually requires treating the petroleum streams with hydrogen in the presence of a supported catalyst at hydrotreating conditions. The catalyst is typically comprised of a Group VI metal with one or more Group VIII metals as promoters on a refractory support. Hydrotreating catalysts that are particularly suitable for hydrodesulfurization, as well as hydrodenitrogenation, generally contain molybdenum or tungsten on alumina promoted with a metal such as cobalt, nickel, iron, or a combination thereof. Cobalt promoted molybdenum on alumina catalysts are most widely used when the limiting specifications are hydrodesulfurization, while nickel promoted molybdenum on alumina catalysts are the most widely used for hydrodenitrogenation and partial aromatic saturation.

Much work is also being done to develop more active catalysts and improved reaction vessel designs in order to meet the demand for more effective hydroprocessing processes. Various improved hardware configurations have been suggested. One such configuration is a countercurrent design wherein the feedstock flows downwardly through successive catalyst beds counter to upflowing treat gas, which is typically a hydrogen containing treat-gas. The downstream catalyst beds, relative to the flow of feed, can contain high performance, but otherwise more sulfur sensitive catalysts because the upflowing treat gas carries away heteroatom components, such as $H_2S$ and $NH_3$, that are deleterious to sulfur and nitrogen sensitive catalysts.

Other process configurations include the use of multiple reaction stages, either in a single reaction vessel, or in separate reaction vessels. More sulfur sensitive catalysts can be used in the downstream stages as the level of heteroatom components becomes successively lower. European Patent Application 93200165.4 teaches a two-stage hydrotreating process performed in a single reaction vessel, but there is no suggestion of a unique stripping arrangement for the liquid reaction stream from each reaction stage.

Two types of process schemes are commonly employed to achieve substantial hydrodesulfurization (HDS)/ aromatics saturation (ASAT) of distillate fuels and both are operated at relatively high pressures. One is a single stage process using Ni/Mo or Ni/W sulfide catalysts operating at pressures in excess of 800 psig. To achieve high levels of saturation pressures in excess of 2,000 psig are required. The other process scheme is a two stage process in which the feed is first processed over a Co/Mo, Ni/Mo or Ni/W sulfide catalyst at moderate pressure to reduce heteroatom levels while little aromatics saturation is observed. After the first stage, the product stream is stripped to remove $H_2S$, $NH_3$ and light hydrocarbons. The first stage product is then reacted over a Group VIII metal hydrogenation catalyst at elevated pressure to achieve aromatics saturation. Such two stage processes are typically operated between 600 and 1,500 psig.

In light of the above, there is a need for improved desulfurization/aromatic saturation process for treating feedstreams so that they can meet the ever stricter environmental regulations.

SUMMARY OF THE INVENTION

In accordance with the present invention there is provided a multi-stage process for reducing the sulfur and aromatics content of a distillate boiling range feedstock containing greater than 1,000 wppm sulfur, which process comprises:

a) reacting said feedstock in a first reaction stage in the presence of a hydrogen-containing treat gas, said first stage containing one or more reaction zones operated at hydrodesulfurization conditions, including temperatures from about 200° C. to about 300° C., and pressures from about 100 to 1,000 psig, wherein each reaction zone contains a bed of hydrodesulfurization catalyst comprised of at least one Group VI metal and at least one Group VIII metal on a refractory support, thereby resulting in a partially desulfurized feedstock containing from about 100 wppm to about, but not including, 1,000 wppm sulfur;

b) reacting the partially desulfurized feedstock from said first reaction stage in a second reaction stage in the presence of a hydrogen-containing treat gas cascaded from, or partially cascaded from, the third stage herein, said first second stage containing one or more reaction zones operated at hydrodesulfurization conditions, including temperatures from about 200° C. to about 300° C., and pressures from about 100 to 1,000 psig, wherein each reaction zone contains a bed of hydrotreating catalyst comprised of at least one Group VI metal and at least one Group VIII metal on a refractory support, and wherein said second reaction stage is operated in the substantial absence of recycle hydrogen-containing treat gas;

c) passing the resulting desulfurizied feedstock to a separation zone wherein a vapor phase stream and a liquid phase stream are produced;

d) collecting said vapor phase stream overhead; and e) passing said liquid phase stream to a third reaction stage in the presence of a hydrogen-containing treat gas, said reaction stage containing one or more reaction zones operated at aromatics saturation conditions including temperatures of about 2000 to 400° C. and pressures of about 100 to 1,000 psig, wherein each reaction zone contains a bed of aromatics saturation catalyst, and wherein said hydrogen-containing treat gas is passed through said reaction stage countercurrent to the flow of said liquid phase stream, wherein said third reaction stage is operated in the substantial absence of recycle hydrogen-containing treat gas.

In a prefered embodiment of the present invention, the liquid phase stream, before it passes through said second reaction stage is contacted with a vapor to strip dissolved gases from the liquid phase.

BRIEF DESCRIPTION OF THE FIGURE

The FIGURE hereof shows three reaction stages—two hydrodesulfurization stages and one hydrogenation (aromatics saturation) stage. The reaction product from the second reaction stage is passed to a separation zone thereby producing a liquid phase product and a vapor phase product. The liquid phase product is further processed in a hydrogenation stage to reduce the level of aromatics.

DETAILED DESCRIPTION OF THE INVENTION

Feedstocks suitable for being treated in accordance with the present invention are those petroleum based feedstocks boiling in the distillate and above range. Sulfur levels of such distillate feedstocks are typically greater than about 1,000 wppm, more typically greater than about 3,000 wppm. Non-limiting examples of such feeds include diesel fuels, jet fuels, heating oils, and lubes. Such feeds typically have a boiling range from about 150° C. to about 600° C., preferably from about 175° C. to about 400° C. It is highly desirable for the refiner to upgrade these types of feedstocks by removing as much of the sulfur as possible, as well as to saturate aromatic compounds.

The process of the present invention can be better understood by a description of a preferred embodiment illustrated by the FIGURE hereof. The current invention offers an improvement over the prior art by using only once through hydrogen treat gas. For purposes of discussion, the first reaction stage R1 is a hydrotreating stage to further reduce the level of sulfur and nitrogen, and the second reaction stage R2 is an aromatics saturation stage. The hydrogen reacts with the impurities to convert them to $H_2S$, $NH_3$, and water vapor, which are removed as part of the vapor effluent, and it also saturates olefins and aromatics. Miscellaneous reaction vessel internals, valves, pumps, thermocouples, and heat transfer devices etc. are not shown for simplicity. The Figure shows reaction vessel R1 which contains reaction zones 10*a* and 10*b*, each of which is comprised of a bed of hydrotreating catalyst, although only a single or more than two reaction zones can be employed. It is preferred that the catalyst be in the reactor as a fixed bed, although other types of catalyst arrangements can be used, such as slurry or ebullating beds. Downstream of each reaction zone is a non-reaction zone 12*a* and 12*b*. The non-reaction zone is typically void of catalyst, that is, it will be an empty section in the vessel with respect to catalyst. Although not shown, there may also be provided a liquid distribution means upstream of each reaction stage. The type of liquid distribution means is believed not to limit the practice of the present invention, but a tray arrangement is preferred, such as sieve trays, bubble cap trays, or trays with spray nozzles, chimneys, tubes, etc. A vapor-liquid mixing device (not shown) can also be employed in non-reaction zone 12*a* for the purpose of introducing a quench fluid (liquid or vapor) for temperature control.

The feedstream is fed to reaction vessel R1 via line 10 along with a hydrogen-containing treat gas via line 12. The hydrogen-containing treat gas is cascaded from reaction stage R2. Make up hydrogen-containing treat gas can also be added via line 14. It is preferred that the rate of intoduction of treat gas be less than or equal to 3 times the chemical hydrogen consumption of the reactions in both stages, more preferably less than about 2 times, and most preferably less than about 1.5 times. The feedstream and hydrogen-containing treat gas pass, cocurrently, through the one or more reaction zones of reaction vessel R1, which represents the first reaction stage wherein the feedstream is further hydrotreated to remove substantially all of the heteroatoms from the feedstream. It is preferred that the first reaction stage contain a Co—Mo, or Ni—Mo, on refractory support catalyst, and a downstream reaction stage contain a Ni—Mo on refractory support catalyst.

The term "hydrotreating" as used herein refers to processes wherein a hydrogen-containing treat gas is used in the presence of a suitable catalyst which is primarily active for the removal of heteroatoms, such as sulfur, and nitrogen, and for some hydrogenation of aromatics. Suitable hydrotreating catalysts for use in the present invention are any conventional hydrotreating catalyst and includes those which are comprised of at least one Group VIII metal, preferably Fe, Co and Ni, more preferably Co and/or Ni, and most preferably Co; and at least one Group VI metal, preferably Mo and W, more preferably Mo, on a high surface area support material, preferably alumina. Other suitable hydrotreating catalyst supports include zeolites, amorphous silica-alumina, and titania-alumina. Noble metal catalysts can also be employed, preferably when the noble metal is selected from Pd and Pt. It is within the scope of the present invention that more than one type of hydrotreating catalyst be used in the same reaction vessel. The Group VIII metal is typically present in an amount ranging from about 2 to 20 wt. %, preferably from about 4 to 12%. The Group VI metal will typically be present in an amount ranging from about 5 to 50 wt. %, preferably from about 10 to 40 wt. %, and more preferably from about 20 to 30 wt. %. All metals weight percents are on support. By "on support" we mean that the percents are based on the weight of the support. For example, if the support were to weigh 100 g. then 20 wt. % Group VIII metal would mean that 20 g. of Group VIII metal was on the support. Typical hydrotreating temperatures range from about 100° C. to about 400° C. with pressures from about 50 psig to about 3,000 psig, preferably from about 50 psig to about 2,500 psig.

A combined liquid phase and vapor phase product stream exit reaction vessel R1 via line 16 and into separation zone S wherein a liquid phase product stream is separated from a vapor phase product stream. The liquid phase product stream will typically be one that has components boiling in the range from about 150° C. to about 650° C., but will not have a boiling range greater than the feedstream. The vapor phase product stream is collected overhead via lie 18.

The liquid reaction product from separation zone S is passed to reaction vessel R2 via line 20 and is passed downwardly through the reaction zones 22*a* and 22*b* of reaction stage R2. Prior to being passed downwardly through reaction stage R2, said liquid reaction product stream can first be contacted in a stripping zone to remove entrapped vapor components from the liquid stream. For example, as the liquid product stream flows through the stripping zone, it is contacted by upflowing hydrogen-containing treat gas under conditions effective for transferring at least a portion of the feed impurities in the vapor into the liquid. The contacting means comprises any known vapor-liquid contacting means, such as rashig rings, berl saddles, wire mesh, ribbon, open honeycomb, gas-liquid contacting trays, such as bubble cap trays and other devices, etc.

Fresh hydrogen-containing treat gas is introduced into reaction stage R2 via line 24 and is passed in an upward direction counter to the flow of liquid reaction product. The introduction of clean treat gas (gas substantially free of $H_2S$ and $NH_3$ allows reaction stage R2 to be operated more efficiently owing to a reduction in the activity suppression effects on the catalyst exerted by $H_2S$ and $NH_3$ and an increase in $H_2$ partial pressure. This type of two stage operation is particularly attractive for very deep removal of sulfur and nitrogen or when a more sensitive Cyst (i.e., hydrocracking, aromatic saturation, etc.) is used in the second reactor. Another advantage of the present invention is that the treat gas rate is relatively low compared with more conventional processes. The use of relatively low treat gas rates is primarily due to the use of previously hydrotreated distillate feedstocks. Further efficiencies are gained by not requiring recycle of treat gas.

The liquid/vapor separation step (S) may be a simple flash or may involve the addition of stripping steam or gas to improve the removal of $H_2S$ and $NH_3$. The liquid stream and treat gas are passed countercurrent to each other through one or more catalyst beds, or reaction zones, 22*a* and 22*b*. The resulting liquid product stream exits reaction stage R2 via line 26, and a hydrogen-containing vapor product steam exits reaction stage R2 and is cascaded to reaction stage R1. Reaction stage R2 also contains non action zones 23*a* and 23*b* following each reaction zones. The catalyst in this second reaction stage is an aromatic saturation catalyst.

The figure also shows several options. For example, lines 30 and 32 can carry kerosene which can be used as a quench fluid. Also a unsaturated feedstock can also be introduced into the first reaction stage via line 28. The degree of unsaturation can be up to about 50 wt. %.

The reaction stages used in the practice of the present invention are operated at suitable temperatures and pressures for the desired reaction. For example, typical hydroprocessing temperatures will range from about 40° C. to about 450° C. at pressures from about 50 psig to about 3,000 psig, preferably 50 to 2,500 psig.

For purposes of hydroprocessing and in the context of the invention, the terms "hydrogen" and "hydrogen-containing treat gas" are synonymous and may be either pure hydrogen or a hydrogen-containing treat gas which is a treat gas stream containing hydrogen in an amount at least sufficient for the intended reaction, plus other gas or gasses (e.g., nitrogen and light hydrocarbons such as methane) which will not adversely interfere with or affect either the reactions or the products. Impurities, such as $H_2S$ and $NH_3$ are undesirable and, if present in significant amounts, will normally be removed from the treat gas, before it is fed into the reactor. The treat gas stream introduced into a reaction stage will preferably contain at least about 50 vol. %, more preferably at least about 75 vol. % hydrogen, and most preferably at least 95 vol. %. In operations in which unreacted hydrogen in the vapor effluent of any particular stage is used for hydroprocessing in any stage, there must be sufficient hydrogen present in the fresh treat gas introduced into that stage, for the vapor effluent of that stage to contain sufficient hydrogen for the subsequent stage or stages. It is preferred in the practice of the invention, that all or a portion of the hydrogen required for the first stage hydroprocessing be contained in the second stage vapor effluent fed up into the first stage. The first stage vapor effluent will be cooled to condense and recover the hydrotreated and relatively clean, heavier (e.g., $C_4$–$C_{5+}$) hydrocarbons.

Non-limiting examples of aromatic hydrogenation catalysts include nickel, cobalt-molybdenum, nickel-molybdenum, and nickel-tungsten. Noble metal containing catalysts can also be used. Non-limiting examples of noble metal catalysts include those based on platinum and/or palladium, which is preferably supported on a suitable support material, typically a refractory oxide material such as alumina, silica, alumina-silica, kieselguhr, diatomaceous earth, magnesia, and zirconia. Zeolitic supports can also be used. Such catalysts are typically susceptible to sulfur and nitrogen inhibition or poisoning. The aromatic saturation stage is preferably operated at a temperature from about 40° C. to about 400° C., more preferably from about 200° C. to about 350° C., at a pressure from about 100 psig to about 3,000 psig, preferably from about 200 psig to about 1,200 psig, and at a liquid hourly space velocity (LHSV) of from about 0.3 V/V/Hr. to about 10 V/V/Hr, preferably from about 1 to 5 V/V/Hr.

The liquid phase in the reaction vessels used in the present invention will typically consist primarily of the higher boiling point components of the feed. The vapor phase will typically be a mixture of hydrogen-containing treat gas, heteroatom impurities like $H_2S$ and $NH_3$, and vaporized lower-boiling components in the fresh feed, as well as light products of hydroprocessing reactions. If the vapor phase effluent still requires further hydroprocessing, it can be passed to a vapor phase reaction stage containing additional hydroprocessing catalyst and subjected to suitable hydroprocessing conditions for further reaction. Alternatively, the hydrocarbons in the vapor phase products can be condensed via cooling of the vapors, with the resulting condensate liquid being recycled to either of the reaction stages, if necessary. It is also within the scope of the present invention that a feedstock which already contains adequately low levels of heteroatoms be fed directly into the reaction stage for aromatic saturation and/or cracking.

What is claimed is:

1. A two stage process for hydroprocessing a hydrotreated distillate feedstock which process consisting essentially of:

a) reacting said hydrotreated distillate feedstock in a first reaction stage in the presence of a once-through hydrogen-containing treat gas cascaded from the second reaction stage herein, said first reaction stage containing one or more reaction zones operated at hydrodesulfurization conditions wherein each reaction zone contains a bed of hydrotreating catalyst, and wherein said once-through hydrogen-containing treat gas cascaded from the second reaction stage comprises all of the vapor effluent from the second reaction stage;

b) passing the resulting reactant to a separation zone wherein a vapor phase stream and a liquid phase stream are produced;

c) collecting said vapor phase stream overhead;

d) introducing fresh hydrogen-containing treat gas into a second reaction stage; and e) passing said liquid phase stream to a said second reaction stage in the presence of said fresh hydrogen-containing treat gas from step (d), said second reaction stage containing one or more reaction zones operated at aromatics saturation conditions wherein each reaction zone contains a bed of aromatics saturation catalyst, and wherein said hydrogen-containing treat gas is passed through said reaction stage countercurrent to the flow of said liquid phase stream.

2. The process of claim 1 wherein the liquid phase stream, before it passes through said second reaction stage is stripped to reduce its content of dissolved vapor phase product by contacting the liquid with a stripping gas.

3. The process of claim 2 wherein the stripping gas is the vapor phase effluent from the second reaction stage.

4. The process of claim 3 wherein the stripping gas and liquid phase stream is contacted in a vapor/liquid contacting zone which is vertically disposed above the second reaction zone.

5. The process of claim 4 wherein the vapor/liquid contacting zone is operated in countercurrent flow wherein vapor flows counter to the downward flowing liquid phase stream.

6. The process of claim 1 wherein the vapor phase stream from the first reaction stage is cooled and the resulting condensed liquid stream is separated from the remaining uncondensed stream, and a portion of the condensed liquid stream is combined with the liquid feed to the first reaction stage.

7. The process of claim 2 wherein the vapor phase steam from the fist reaction stage is cooled and the resulting condensed liquid stream is separated from the remaining uncondensed stream, and a portion of the condensed liquid stream is combined with the liquid feed to the second reaction stage.

8. The process of claim 4 wherein the vapor phase stream from the first reaction stage is cooled and the resulting condensed liquid stream is separated from the remaining uncondensed stream, and a portion of the condensed liquid stream is used as a quench liquid between two or more of the reaction zones of the first or second reaction stage.

9. The process of claim 4 wherein the first reaction stage is vertically disposed above the vapor/liquid contacting zone.

10. The process of claim 9 wherein the liquid feedstock flows downward through said one or more reaction zones countercurrent to said hydrogen-containing treat gas.

11. The process of claim 1 wherein the hydrogen-containing treat gas is cascaded from a vapor/liquid contacting zone which is vertically disposed above the second reaction zone.

* * * * *